United States Patent [19]

Owen

[11] Patent Number: 5,019,239

[45] Date of Patent: May 28, 1991

[54] INVERTED FRACTIONATION APPARATUS AND USE IN A HEAVY OIL CATALYTIC CRACKING PROCESS

[75] Inventor: Hartley Owen, Belle Mead, N.J.

[73] Assignee: Mobil Oil Corp., Fairfax, Va.

[21] Appl. No.: 439,755

[22] Filed: Nov. 21, 1989

[51] Int. Cl.[5] ..... C10G 9/16

[52] U.S. Cl. ..... 208/48 Q; 208/100; 208/103; 208/348

[58] Field of Search ..... 208/48 Q, 48 R, 100, 208/101, 103, 348, 368

[56] References Cited

U.S. PATENT DOCUMENTS

| | | | |
|---|---|---|---|
| 3,338,821 | 8/1967 | Moyer et al. | 208/113 |
| 3,547,805 | 12/1970 | Mitchell | 208/348 |
| 3,676,519 | 7/1972 | Dorn et al. | 208/48 Q |
| 3,786,110 | 1/1974 | Oleszko | 208/48 Q |
| 4,033,856 | 7/1977 | Colvert et al. | 208/103 |
| 4,049,540 | 9/1977 | Veda et al. | 208/48 Q |
| 4,623,443 | 11/1986 | Washer | 208/95 |
| 4,776,948 | 10/1988 | Skraba | 208/104 |

OTHER PUBLICATIONS

*Troubleshooting Process Operations* (Second Edition), Norman P. Lieberman; PennWell Publishing Company.

*Primary Examiner*—Curtis R. Davis
*Assistant Examiner*—William Dremler
*Attorney, Agent, or Firm*—Alexander J. McKillop; Charles J. Speciale; Richard D. Stone

[57] ABSTRACT

A process and apparatus for fractionation of a superheated vapor in a fractionation column is disclosed. A conventional fractionator, having an inlet for hot vapors at the base, and a plurality of products withdrawn via side draws is modified by physically inverting some parts of the column. The superheated vapors are charged to an upper portion of the column, to contact and vaporize a liquid fraction pumped up from a lower portion of the column. The vaporized liquid is discharged as a vapor fraction to the base of the column from which the liquid fraction was obtained. Superheated vapor fed to the column is fractionated, but in a fractionator in which the hottest part of the column is not in the base of the column. The inverted fractionator, when used in conjunction with a riser cracking FCC reactor, greatly reduces thermal cracking in a transfer line moving superheated, cracked vapor from the reactor to the fractionator. The inverted fractionator improves yields, and permits higher cracking reactor temperatures to be used.

13 Claims, 2 Drawing Sheets

INVERTED FRACTIONATION APPARATUS AND USE IN A HEAVY OIL CATALYTIC CRACKING PROCESSBACKGROUND OF THE INVENTION

1. Field of the Invention

The field of the invention is fractionation or distillation in general and fractionation of cracked products from catalytic cracking of heavy hydrocarbon feeds in particular.

2. Description of Related Art

Fractional distillation is an ancient art. It has been used throughout history by those wanting to separate two miscible liquids having different boiling points.

Simple distillation was done in a single vessel, sometimes called a pot still. This provided one good stage of separation, and was adequate for recovering ethanol from an aqueous mixture of ethanol and water. The same approach was used to separate, more or less, various fractions of crude petroleum.

Modern refineries and petrochemical facilities contain multiple, multi-tray or multi-stage distillation columns. Some years ago, many refineries consisted essentially of a large crude column, which separated the crude into fractions ranging from light gas, to propane, to naphtha, to gas oil and residual fractions.

With the advent of catalytic cracking processes, the heavy fractions of the crude were converted to lighter, more valuable products. Again a large distillation column, sometimes called a "Syncrude" column was used to separate cracked products into gasoline, light fuel oil etc. The catalytically cracked material contained a full spectrum of boiling range materials, and could be regarded as a synthetic crude, hence the term "Syncrude Column."

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425 C.-600 C., usually 460 C.-560 C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500 C.-900 C., usually 600 C.-750 C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Modern catalytic cracking units use active zeolite catalyst to crack the heavy hydrocarbon feed to lighter, more valuable products. Instead of dense bed cracking, with a hydrocarbon residence time of 20-60 seconds, much less contact time is needed. The desired conversion of feed can now be achieved in much less time, and more selectively, in a dilute phase, riser reactor.

Riser cracking is more selective than dense bed cracking. Refiners maximized riser cracking benefits, but in so doing induced, inadvertently, a significant amount of thermal cracking. Thermal cracking is not as selective as either riser cracking or dense bed cracking, and most refiners would deny doing any thermal cracking, while building and operating FCC units with all riser cracking which also did a significant amount of thermal cracking.

Thermal cracking was caused by the use of upflow riser reactors, which discharged cracked products more than a 100 feet up, and use of product fractionation facilities which charged the hot vapors from the FCC unit to the bottom of the main column. The transfer lines from the FCC to the main column, or Syncrude column, kept getting longer, and the material exiting the riser reactor kept getting hotter, and the combination caused thermal cracking.

Distillation of cracked products has not changed significantly, it is still done in a large fractionator. The fractionator has to be tall because it separates a single vapor stream (catalytically cracked product) into a variety of products, from propanes to a heavy residual fraction such as a slurry oil.

The reasons for high risers in FCC, and for adding hot vapor to the bottom of the FCC main column will be briefly reviewed. After this, some other work on minimizing thermal cracking in riser cracking FCC units will be reviewed.

Risers are tall because of high vapor velocities and residence time. The FCC riser operates in dilute phase flow. There is better distribution of catalyst across the riser when vapor velocities are fairly high. Many FCC riser reactors now operate with vapor velocities on the order of 40-100 feet per second. To achieve enough residence time in the riser, the riser must be very tall. For a two second hydrocarbon residence time, the riser must be at least 100 feet long with a 50 fps vapor velocity. There usually must be additional space provided at the base of the riser reactor to add catalyst and more space for feed nozzles. The cracked vapor products exit the riser and enter a reactor vessel, at an elevation more than 100 feet in the air, for separation of spent catalyst from cracked products, usually in one or more stages of cyclone separation. The cracked products are eventually discharged, usually up, from the separation section, usually at an elevation well above the top of the riser, and charged to the base of the main column.

Hot vapors from the FCC unit are charged to the base of the main column for several reasons, but primarily so that the hot vapors may be used to heat the column. Another reason is that the hot vapors always contain some catalyst and catalyst fines, which are never completely removed in the FCC reactor, despite the use of multiple stages of cyclone separators. Adding the fines laden vapor to the bottom of the main column at least minimizes amount of fines that must circulate through the column. The fines are largely confined to the very base of the column. The lower trays or packing of the main column are designed to tolerate the fines, as with the using of sloping trays that permits fines to drain or be swept from a tray without clogging the tray.

The combination of high temperatures in the riser reactor (many times exceeding 1000 F.), a tall riser reactor, and a bottom fed main column, give enough residence time to cause a significant amount of thermal cracking to occur in the transfer line between the riser reactor and fractionator.

As the process and catalyst improved, refiners attempted to use the process to upgrade a wider range of feedstocks, in particular, feedstocks that were heavier.

These heavier, dirtier feeds have placed a growing demand on the reactor and on the regenerator. Processing resids exacerbated existing problem areas in the riser reactor, namely feed vaporization, catalyst oil contact, accommodation of large molar volumes in the riser, and coking in the transfer line from the reactor to the main fractionator.

Although many improvements were made in the FCC process, and the cracking catalyst, there was no significant change in the way the distillation column operated. It could be made a little shorter by the use of tower packing rather than trays, and this would also lower pressure drop some through the column, which improved operation of the cracking unit some, but did nothing to eliminate the coking and thermal reactions which were occurring between the riser reactor outlet (at an elevation 40 to 70 m or more) and the base of the main column (with a vapor line inlet at an elevation of 5 to 10 m at most).

Tremendous improvements were being made in the zeolite catalyst used in the cracking reaction, but the exquisitely cracked product was then being degraded somewhat on its way to the base of the fractionator.

Coking in the transfer lines connecting the FCC reactor vapor outlet with the main column is now a severe problem in some refineries. FCC operators have long known that "dead spaces" in a line could lead to coke formation. Coke formation is a frequently encountered problem in the "dome" or large weldcap which forms the top of the vessel housing the riser reactor cyclones. Coking in the transfer line is somewhat related, in that coke will form in stagnant or dead areas of the transfer line. Coke will also form if there are cool spots in the transfer line. The cool spots allow some of the heaviest material in the reactor effluent vapor to condense. These heavy materials, some of which may be entrained asphaltenic materials, will form coke if allowed to remain for a long time in the transfer line. Thus refiners have tried to insulate the transfer line to the main column, not only to prevent heat loss to the atmosphere, but also to prevent coking in this line. The problem of coke formation gets more severe with either an increase in reactor/transfer line temperatures, or with a decrease in feed quality so that it contains more heavier materials.

A closely related problem was unselective thermal cracking of the valuable cracked products in the transfer line to the main column. This degraded the product, but at least did not shut the unit down.

I examined the work that others had done, and realized that it was time for a new approach. I wanted the benefits of short residence time riser cracking, without unselective thermal cracking or coke formation in transfer lines.

I wanted the option to bring the FCC main column closer to the FCC reactor. This could permit a lower pressure in the FCC riser reactor, higher vapor velocity in the transfer line, less energy consumption in moving thousands of barrels a day of cracked product through the transfer line, and reduced thermal degradation of cracked products in the transfer line. I knew I could not eliminate completely the problem (the transfer line), but I realized that I could eliminate most of it by inverting the main column.

BRIEF SUMMARY OF THE INVENTION

Accordingly, the present invention provides a process for fractionating a superheated, cracked vapor stream having a temperature above about 750 F. and comprising a full boiling range cracked product stream including normally gaseous hydrocarbons, at least a plurality of normally liquid product streams selected from the group of naphtha boiling range hydrocarbons, light cycle oil boiling range hydrocarbons, heavy cycle oil boiling range hydrocarbons and mixtures thereof into liquid product fractions, said process comprising charging said superheated vapor to a vertical distillation apparatus having a height of at least 20 meters, and comprising an upper desuperheating zone and a lower fractionation zone; cooling and condensing at least a portion of said superheated cracked vapor in said upper desuperheating zone, said upper desuperheating zone comprising: a vapor inlet having an elevation of at least 10 meters for superheated vapor: a liquid inlet at an upper portion of said desuperheating zone for addition of a recycled liquid hydrocarbon stream having a boiling point from said lower fractionation zone; a vapor liquid contact means intermediate said superheated vapor inlet and said vaporizable liquid inlet for direct contact heat exchange of superheated vapor with said vaporizable liquid to produce a vaporized product fraction and a condensed heavy liquid product; at least one vapor outlet at an upper portion of said desuperheating zone connective with said lower fractionation section for removal of vaporized product from the desuperheating zone; at least one heavy liquid product outlet at a lower portion of said desuperheating zone for removal of a hydrocarbon liquid stream comprising hydrocarbons having a boiling point above the boiling point of said recycled liquid hydrocarbon stream; and fractionating into product fractions said vaporized product from said desuperheating zone in a lower fractionation zone beneath said desuperheating zone, said fractionation zone having at least a lower portion and an upper portion said fractionation zone comprising: a fractionator vapor liquid contact means for fractionation of said vaporized product fractions from said desuperheating zone into a plurality of normally liquid products a fractionator vapor inlet having an elevation below the desuperheating zone, said vapor inlet connecting the base portion of the fractionator with the vapor outlet of the desuperheating zone a plurality of fractionator product outlets for removal of a plurality of normally liquid products streams selected from the group of naphtha boiling range hydrocarbons, light cycle oil boiling range hydrocarbons, heavy cycle oil boiling range hydrocarbons and mixtures thereof, and a recycle line for recycle of a normally liquid product stream from said fractionation zone up to said desuperheating zone.

In another embodiment, the present invention provides an apparatus for fractionating a superheated vapor stream comprising a plurality of liquid products comprising a vertical distillation apparatus having a height of at least 20 meters, and comprising an upper desuperheating means and a lower fractionation means; said desuperheating means comprising: a vapor inlet having an elevation of at least 10 meters for superheated vapor; a liquid inlet at an upper portion of said desuperheating means for addition of a recycled liquid hydrocarbon stream having a boiling point from the lower fractionation means; a vapor liquid contact means for direct contact heat exchange of superheated vapor with the vaporizable liquid to produce a vaporized product fraction and a condensed heavy liquid product; at least one vapor outlet at an upper portion of said desuperheating means connective with said lower fractionation means for removal of vaporized product from the desuperheating means; at least one heavy liquid product outlet at a lower portion of said desuperheating means for removal of a hydrocarbon liquid stream comprising hydrocarbons having a boiling point above the boiling point of the recycled liquid hydrocarbon stream; and a fractionation means for fractionating the vaporized product from the desuperheating, said fractionation means comprising at least a lower portion and an upper portion and comprising: a fractionator vapor liquid contact means for fractionation of vaporized product fractions from a fractionator vapor inlet having an elevation below the desuperheating means, and located in a base portion of the fractionation means, said fractionator vapor inlet being connective with the vapor outlet of the desuperheating means a plurality of fractionator product outlets for removal of at least a plurality of normally liquid products streams selected from the group of naphtha boiling range hydrocarbons, light cycle oil boiling range hydrocarbons, heavy cycle oil boiling range hydrocarbons and mixtures thereof; and a recycle line for recycle of a normally liquid product stream from said fractionation means up to said desuperheating means.

DETAILED DESCRIPTION

Figure 1:
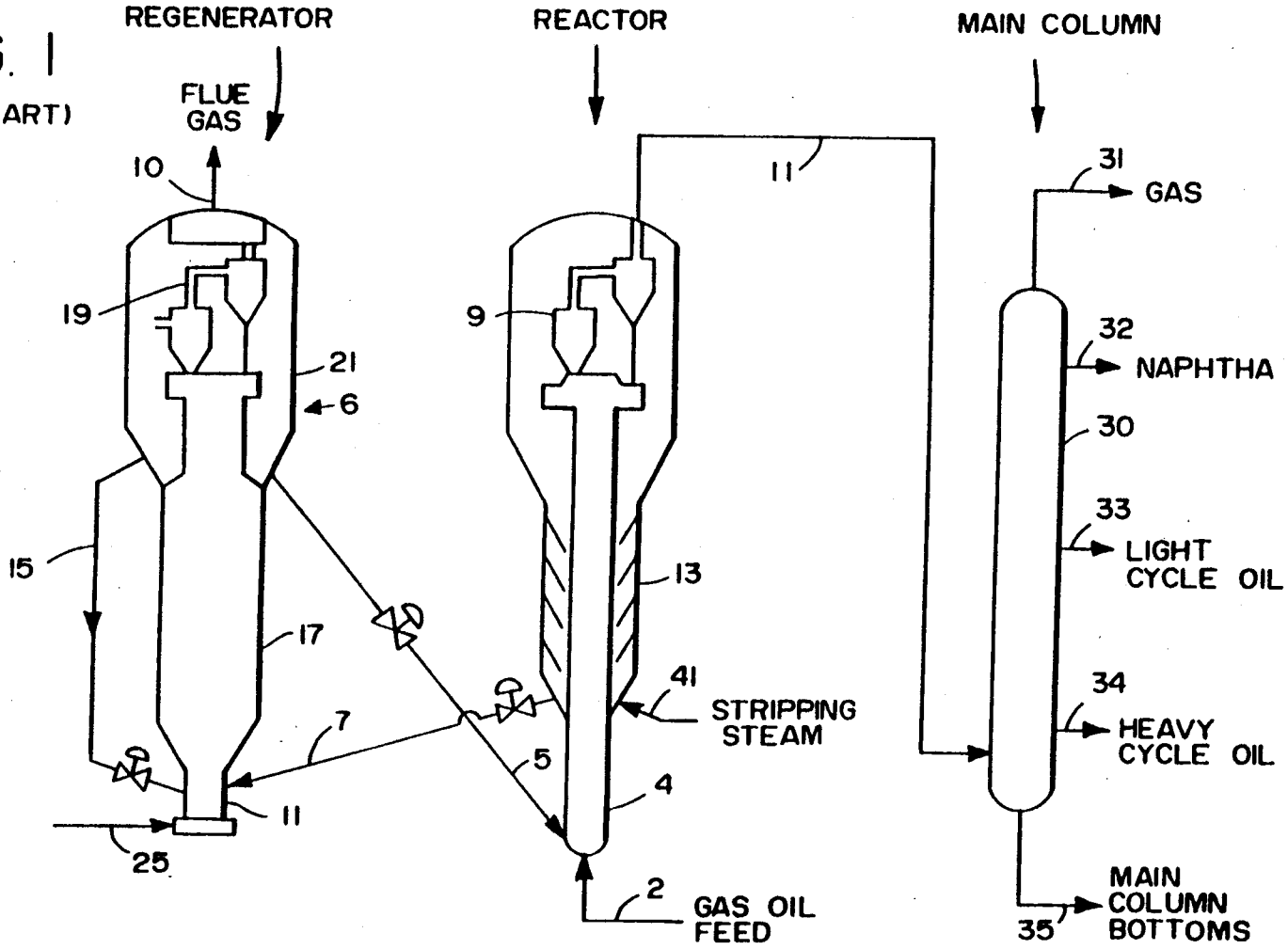
FIG. 1 (PRIOR ART)
FIG. 1 (prior art) is a simplified schematic view of an FCC unit of the prior art, with all riser cracking, and a transfer line from the riser reactor to the main column.

The present invention can be better understood by reviewing it in conjunction with the conventional way of operating an all riser cracking FCC unit. FIG. 1 illustrates a fluid catalytic cracking system of the prior art. It is a simplified version of FIG. 1 of U.S. Pat. No. 4,421,636, which is incorporated herein by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g., a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally as 9 in the Figure.

The riser 4 top temperature, which is usually close to the temperature in conduit 11, ranges between about 480 to 615 C. (900 and 1150 F.), and preferably between about 538 and 595 C. (1000 and 1050 F.). The riser top temperature is usually controlled by adjusting the catalyst to oil ratio in riser 4 or by varying feed preheat.

Cracked products are removed from the FCC reactor via transfer line 11 and charged to the base of the main column 30. In some refineries, this column would be called the Syncrude column, because the catalytic cracking process has created a material with a broad boiling range, something like a synthetic crude oil. The main column 30 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Cyclones 9 separate most of the catalyst from the cracked products and discharges this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section 11 is used t o mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

Thermal cracking degrades the cracked product removed via line 11. The average residence time in the transfer line between the FCC reactor outlet and the main column is usually in excess of 10 seconds, although some units operate with much longer, or slightly shorter, vapor residence times.

The temperature in this line is usually the riser outlet temperature. The combination of time and temperature is enough to cause a significant amount of unselective, and unwanted, thermal cracking upstream of the main column.

There is an additional problem with the prior art design when it is used to crack feeds containing more than 10% non-distillable feeds, or when the feed contains more than 3.5 wt. % CCR. This additional problem is coke formation in the transfer line. It is somewhat related to thermal cracking, but becomes a severe problem only when heavier feedstocks are being cracked. It may be due to carryover or uncracked asphaltenic material, or thermal degradation or polymerization of large aromatic molecules into coke or coke precursors.

Polymerization, or coking in the transfer line need not involve a large fraction of the cracked product to cause a problem with product purity or plugging of the transfer line or the main column. Phrased another way, coking in the unit could shut the unit down, but need not be noticeable in yields. Thermal cracking in the transfer line will cause a significant yield loss, but will not automatically cause coking or plugging of the transfer line. Fortunately both problems are overcome by the process of the present invention, which will be discussed in conjunction with FIG. 2.

Figure 2:
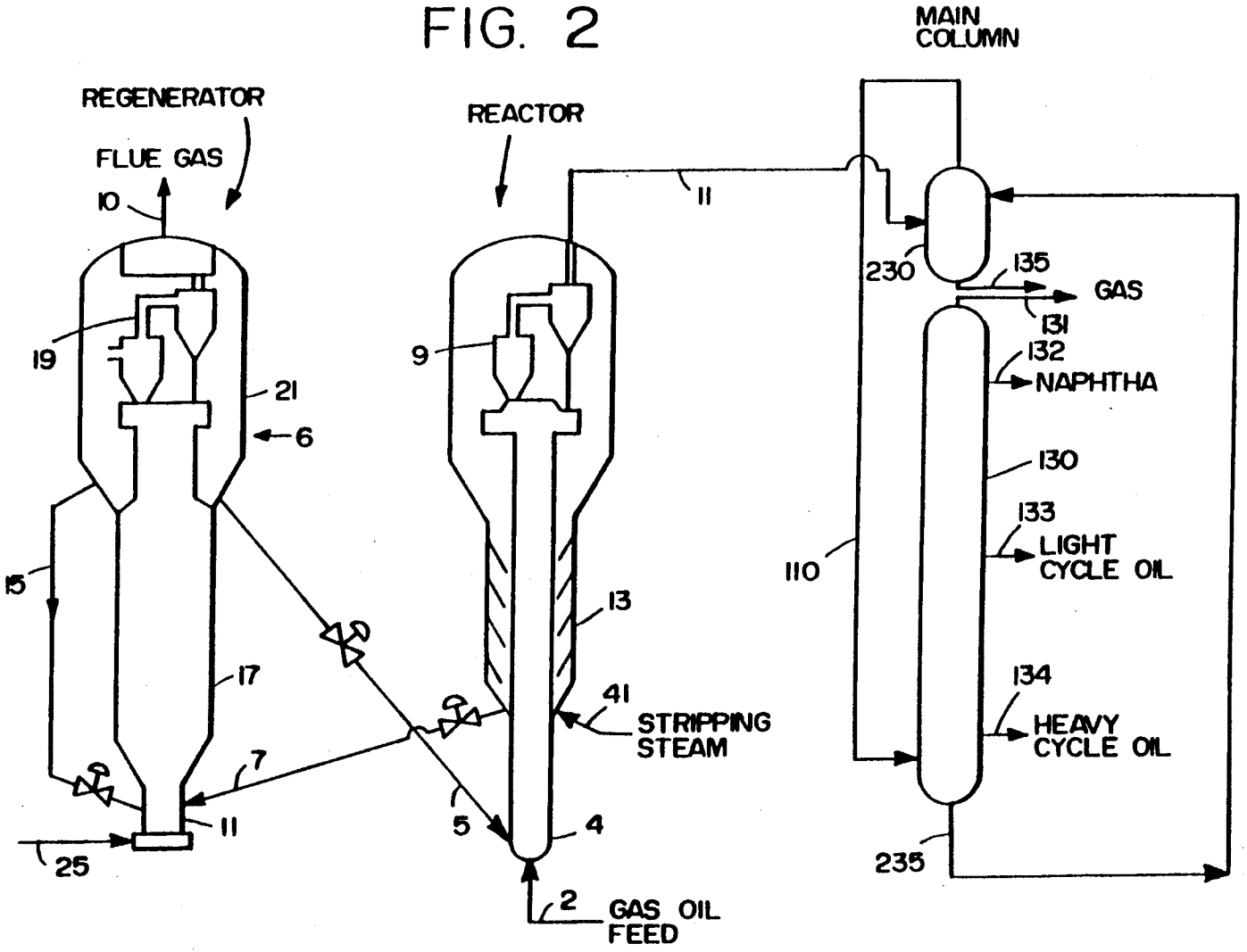
FIG. 2 is a simplified schematic view of an FCC unit of the invention, with an inverted fractionator.

FIG. 2 shows one embodiment of the present invention. Many of the elements in FIG. 2 are identical to those in FIG. 1, and like elements, such as regenerator 6, have like reference numerals in both figures.

The regenerator and reactor operate as in the FIG. 1. A heavy feed, preferably containing more than 10% residual or non-distillable material, is cracked in riser cracker 4. Cracked products are discharged from the riser, pass through two stages of cyclone separation 9 and are discharged via line 11 from the FCC reactor.

The cracked vapors are charged to the inverted fractionator 130. In the embodiments shown, an extra section 230 has been added at the top of the column to accomplish what had conventionally been done at the bottom of the main column in prior art units. Basically, section 230 cools the superheated reactor effluent vapor to its dew point, achieves a minimal amount of fractionation, and transfers heat from the reactor effluent vapors into the column 130.

Superheated cracked vapor in line 11 is charged into zone 230 and cooled by contact with a liquid stream 235 from the bottom of column 130. Most of the heat in the superheated vapor stream in line 11 is recovered by vaporizing the liquid in stream 235 to form a vapor stream 110.

Some of the heat of the superheated vapor in line 11 is recovered in the form of a relatively high temperature liquid stream 135, which preferably corresponds in composition and amount to the FIG. 1 main column bottoms stream 35. This stream 135 represents the heaviest product fraction. Although some of the heat of the cracked product is recovered via liquid stream 135, stream 135 will be cooler than the cracked product vapor stream in line 11.

The vapor fraction generated in zone 230, represents all of the cracked product except for the heaviest product which was removed as a liquid. This vapor fraction is removed via line 110, and charged to the base of column 130 via line 110. Fractionation of this vapor proceeds pretty much as in FIG. 1. Fractionator 130 produces a spectrum of products, from a heavy material such as normally gaseous materials, the vapor stream removed overhead via line 131 from the top of the column to a heavy cycle oil fraction in line 134, a light cycle oil in line 133, and a heavy naphtha fraction in line 132.

By operating with an inverted fractionator, as in the FIG. 2 embodiment, there are some significant improvements in the FCC process, primarily a reduction in thermal cracking in effluent line 11.

This is because of the way riser cracking FCC units have evolved, in relation to the Syncrude tower, or main column, which has not changed much. Both units (riser reactor and main fractionator) are quite tall, and of about the same height. Rather than make cracked vapor travel down from the riser reactor outlet to the inlet of a conventional column, the process and apparatus of the present invention allow cracked vapor to travel mostly sideways to the inverted fractionator. In most refineries this change will reduce the residence time, and thermal cracking, in the transfer line 11 by 50 to 70%.

Now that the invention has been briefly reviewed in conjunction with the review of FIG. 2, a more detailed discussion of feed, catalyst, and equipment will be presented.

FCC FEED

Any conventional FCC feed can be used. The process of the present invention is especially useful for processing difficult charge stocks, those with high levels of CCR material, exceeding 2, 3, 5 and even 10 wt. % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650 F.

The most uplift in value of the feed will occur when at least 10 wt. %, or 50 wt. % or even more of the feed has a boiling point above about 1000 F., or is considered non-distillable.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC catalyst vendors.

The FCC catalyst composition, per se, forms no part of the present invention.

FCC REACTOR CONDITIONS

Conventional riser cracking conditions may be used. Typical riser cracking reaction conditions include catalyst/oil ratios of 0.5:1 to 15:1 and preferably 3:1 to 8:1, and a catalyst contact time of 0.1 to 50 seconds, and preferably 0.5 to 5 seconds, and most preferably about 0.75 to 2 seconds, and riser top temperatures of 900 to about 1050 F.

The process of the present invention tolerates and encourages use of unconventional reactor conditions. Riser top temperatures of 1100 F., 1150 F., 1200 or even higher can be tolerated in the process of the present invention, and are preferred when the feed is heavy, and contains 10% or more of resid. Unusually short riser residence times are possible at such high temperatures, so riser hydrocarbon residence times of 0.1 to 5 seconds may be used., e.g., 0.2 to 2 seconds.

It is preferred, but not essential, to use an atomizing feed mixing nozzle in the base of the riser reactor, such as ones available from Bete Fog. More details of use of such a nozzle in FCC processing is disclosed in USSN 229,670, which is incorporated herein by reference.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in Haddad et al U.S. Pat. No. 4,502,947.

It is preferred but not essential, to rapidly strip the catalyst, immediately after it exits the riser, and upstream of the conventional catalyst stripper. Stripper cyclones disclosed in Schatz and Heffley U.S. Pat. No. 4,173,527, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in Owen et al U.S. Pat. No. 3,821,103, which is incorporated herein by reference. If hot stripping is used, a catalyst cooler may be used to cool the heated catalyst before it is sent to the catalyst regenerator. A preferred hot stripper and catalyst cooler is shown in Owen U.S. Pat. No. 4,820,404, which is incorporated herein by reference.

The FCC reactor and stripper conditions, per se, can be conventional.

CATALYST REGENERATION

The process and apparatus of the present invention can use conventional FCC regenerators.

Preferably a high efficiency regenerator, such as is shown in the Figures, is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention. In most units, the existing regenerator will be used to practice the present invention.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit.

INVERTED FRACTIONATOR

The process and apparatus of the present invention can use conventional fractionators, arranged unconventionally.

The inverted column of the present invention must contain at least two elements, an elevated bottoms section 230 and a fractionation section such as 130.

The elevated bottoms section 230 can be a conventional bubble cap tray fractionator, a packed column, or simply a single large open chamber with an efficient liquid distribution system, such as a spray nozzle, to contact hot vapors with liquid from the base of the fractionation section 130.

The conditions in zone 230 are similar to those existing in the base of the main fractionator of FIG. 1. The same methods used to achieve good vapor/liquid contact and deal with the presence of catalyst fines used for prior art main columns can be used as a guide to designing the mini-fractionator 230.

Zone 230 need not be, and preferably is not, very high. This is because zone 230 will be fairly high up, preferable mounted alongside of or above the main fractionator 130. It is expensive to provide a great number of fractionation trays, or a sufficient amount of column packing, starting 30 or 40 meters up in the air.

There is a great economic benefit from having a single theoretical tray of fractionation, but less benefit from providing many theoretical trays at this elevation. There is no detriment to achieving some fractionation, and with the use of efficient packing materials it may be beneficial to produce not only a main column bottoms stream 135, but a heavy cycle oil stream, such as 134, from zone 130. The benefit of doing more fractionation in zone 230 is reduced vapor flow in line 110, and reduced pressure in the main column and, more importantly, in the FCC reactor. It is well known that reduced pressure in the FCC reactor improves the process. The process and apparatus of the present invention allow a significant reduction in reactor pressure, by minimizing the distance that cracked vapors must travel, and the pressure drop associated with such vapor flow and the coke laydown in the overhead line that often occurs.

Radical reductions in pressure of the FCC reactor can be achieved by compressing the vapor in line 110. This permits the pressure of the FCC reactor, and zone 230, to be run at any desired level. There is some capital expense associated with vapor compression, but this will be largely offset by savings in capital cost of the wet gas compressor associated with the unit. There are some operating costs associated with running the vapor compressors, but this energy expense can be recovered in the form of higher grade heat in the main fractionation section 130.

In many existing FCC units, especially those with large sieve tray or bubble cap tray fractionators, the optimum method of implementing the present invention may be slightly different than the embodiment shown in the drawing. In these existing units, as in the main crude column for the refinery, the base of the column has a large cross sectional area, and the top of the column has a much smaller cross sectional area, because of the greatly reduced vapor traffic at the top of the column. These older fractionators with sieve trays, or bubble cap columns, are quite tall, because of the great number of trays required, or perhaps because a low efficiency column packing material was used.

For fractionators with some excess number of trays, or columns having a great height which are revamped to packing having a short HETP, Height Equivalent Theoretical Plate, use of an intermediate or upper section of the column may be the most cost effective implementation of the present invention. In these units, or where the cost of providing an elevated section 230 at an elevation of 30 m may be excessive, use of, e.g., the naphtha fractionation portion of an existing Syncrude Tower as zone 230 may be the optimum economic solution. The naphtha fraction section will usually have a large enough cross sectional area so that it can, if the proper packing is placed therein, accommodate the huge volume of vapor flow in the reactor vapor transfer line. Vapor velocities may be much higher than would normally be tolerated in a column, but if all that needs to be achieved is one good stage of vapor liquid equilibrium, then this can be done in an upper section of the column, provided that a packed section, or an open drum, with spray liquid distributors, is used.

Vapor from this intermediate elevation section would be charged to the base of the column. Liquid from this intermediate elevation section would be equivalent to main column bottoms liquid.

Vapor from the light cycle oil region of the column, vapor that heretofore would go into the naphtha fractionation section, will be charged into an upper section of the column.

In effect, the top and bottom of the column are squeezed to free an intermediate or preferably an upper intermediate section, to deal with incoming hot vapor from the FCC reactor.

There will be large amounts of catalyst fines in hot vapor in the transfer line 11, up to a ton per day in some units. Some provision for fines accommodation should be provided in the section 230, or other equivalent section which accepts fines laden vapor. Conventional technology may be used to deal with fines.

COMPARISON OF ESTIMATED YIELDS

The benefits of practicing the present invention can most easily be seen by comparing the yields obtainable in a conventional, prior art FCC unit versus an estimate of the yields obtainable in the same unit by using an inverted fractionator.

Estimate 1—Base Case (Prior Art)

The prior art unit estimate is based on yields obtainable in a conventional unit operating with a riser reactor, a high efficiency regenerator, a conventional catalyst stripper, a conventional transfer line to the main column, and a conventional main column or fractionator.

The reactor conditions included:
Riser Top Temperature=1000 F.
Riser Top pressure=32 psig
Cat:oil Ratio - - - =6.5:1

The feed had a specific gravity of 0.9075. Under these conditions, the unit achieved a 76.11 vol % conversion of feed.

The reactor discharged into a plenum having a volume of 2,154 cubic feet. The transfer line from the plenum to the main column, a volume of 3,291 cubic feet, was about 225 feet of 54" OD line.

The following yield estimate is presented in two parts. The first or base case is with no changes. The unit operates with a plenum chamber and conventional fractionator. The second case uses an inverted fractionator, and continues to use the plenum.

INVERTED FRACTIONATOR STUDY

| CASE: | BASE | INVENTION |
|---|---|---|
| Conversion, Vol. % | 76.11 | −0.10 |
| Gasoline Yield, Vol % | 58.12 | 0.16 |
| Gasoline Octane, RONCL | | −0.09 |

-continued

INVERTED FRACTIONATOR STUDY

| CASE: | BASE | INVENTION |
|---|---|---|
| C2 and lighter wt % | 4.22 | −0.10 |
| C3 + C4 olefins, vol % | 15.06 | −0.15 |
| iC4 vol % | 5.32 | 0.01 |
| Light Fuel Oil | 18.27 | 0.16 |
| Heavy Fuel Oil | 5.62 | −0.06 |
| G + D vol % | 76.39 | 0.32 |
| Coke (weight %) | 5.12 | 0 |
| Diene, ppm, approx. | 5000 | 1000 |
| Acetylenes, ppm | 500 | low |

The practice of the present invention decreases thermal cracking. The ERT, or equivalent reaction time at 800 F. has been greatly reduced. The residence time has been reduced from 3 seconds to one second or less using the inverted fractionator of the invention. This reduction in thermal cracking increases yields of valuable liquid product, and improves product quality. There is a slight decrease in gasoline octane number because thermal cracking produces olefinic gasoline which has a good octane number. Thermal cracking also reduces yields of gasoline The process of the invention can produce even larger increases in G + D yields, or gasoline plus distillate yields, by about 0.80 vol % in new units. This can be done by eliminating the plenum chamber, and putting the inverted main column close to the riser outlet. This could also be done in existing units, but usually the capital costs involved, and site limitations, will make such movement of the main column prohibitively expensive.

In the commercially sized unit which was the basis for this study, processing 96.5 thousand barrels per day of feed, the practice of the present invention results in an increase of 309 barrels of gasoline and distillate product, merely by inverting the main fractionator.

In a new unit, with an inverted fractionator next to the riser reactor vapor outlet, and the plenum eliminated, 772 more barrels of gasoline and distillate product could be obtained as compared to the conventional design with plenum and conventional fractionator.

The process and apparatus of the present invention will allow higher riser top temperatures to be used, and these higher reactor top temperatures will lead to several other benefits which will occur in practice, but are not reflected in the above yield estimates.

Vaporization of all feeds, and especially of resids, is favored by higher reactor temperatures. Much of the base of the riser is devoted to vaporizing the feed, and operating with higher riser temperatures allows more of the riser to be used for vapor phase cracking, rather than vaporization of liquid.

Higher riser top temperatures allow more heat to be removed from the FCC unit with the cracked products. Less heat must be removed in the regenerator. This helps to keep the unit in heat balance. This heat is eventually recovered in downstream fractionators or heat exchangers.

Catalyst stripping will be slightly better at higher temperatures, so higher riser top temperatures will improve somewhat the stripping operation.

This is a generic improvement in FCC (and other) fractionators. It could be used in any unit where a hot vapor stream is added from a relatively high elevation (say 50+ feet up) to the base of a fractionator.

The invention is especially useful in the main column associated with all riser cracking FCC units. It would be beneficial even if no unusual feeds or conditions were being run in the FCC unit, i.e., there would be a small but definite reduction in thermal cracking in the transfer line.

Additional benefits may flow from having a stripping section (steam or vacuum) under the quench section. There would be a large barometric leg available to get hot liquid out of the stripping section. A stripping stage would minimize delta T between the relatively cool light ends section of the column and the hottest spot, the quench point.

I claim:

1. A process for fractionating a superheated, cracked vapor stream having a temperature above about 750 F. and comprising a full boiling range cracked product stream including normally gaseous hydrocarbons, at least a plurality of normally liquid product streams selected from the group of naphtha boiling range hydrocarbons, light cycle oil boiling range hydrocarbons, heavy cycle oil boiling range hydrocarbons and mixtures thereof into liquid product fractions, said process comprising charging said superheated vapor to a vertical distillation apparatus having a height of at least 20 meters, and comprising an upper desuperheating zone and a lower fractionation zone;

cooling and condensing at least a portion of said superheated cracked vapor in said upper desuperheating zone, said upper desuperheating zone comprising:

a vapor inlet having an elevation of at least 10 meters for superheated vapor;

a vaporizable liquid inlet at an upper portion of said desuperheating zone for addition of a recycled liquid hydrocarbon stream having a boiling point from said lower fractionation zone;

a vapor liquid contact means intermediate said superheated vapor inlet and said vaporizable liquid inlet for direct contact heat exchange of superheated vapor with said vaporizable liquid to produce a vaporized product fraction and a condensed heavy liquid product;

at least one vapor outlet at an upper portion of said desuperheating zone connective with said lower fractionation section for removal of vaporized product from the desuperheating zone;

at least one heavy liquid product outlet at a lower portion of said desuperheating zone for removal of a hydrocarbon liquid stream comprising hydrocarbons having a boiling point above the boiling point of said recycled liquid hydrocarbon stream; and fractionating into product fractions said vaporized product from said desuperheating zone in a lower fractionation zone beneath said desuperheating zone, said fractionation zone having at least a lower portion and an upper portion said fractionation zone comprising:

a fractionator vapor liquid contact means for fractionation of said vaporized product fractions from said desuperheating zone into a plurality of normally liquid products, a fractionator vapor inlet having an elevation below the desuperheating zone, said vapor inlet connecting the base portion of the fractionator with the vapor outlet of the desuperheating zone a plurality of fractionator product outlets for removal of a plurality of normally liquid products streams selected from the group of naphtha boiling range hydrocarbons, light cycle oil boiling range hydrocarbons, heavy cycle oil boiling range hydrocarbons and mixtures thereof, and a recycle line for recycle of a normally liquid product stream from said fractionation zone up to said desuperheating zone.

2. The process of claim 1 wherein the superheated vapors are from a riser cracking fluidized catalytic cracking unit which catalytically cracks a heavy hydrocarbon feed to lighter products in a riser reactor and discharges a superheated cracked product vapor phase at an elevation above 30 meters.

3. The process of claim 2 wherein the cracked products exit the top of the riser at a riser outlet temperature above 1000 F.

4. The process of claim 1 wherein said fractionation zone produces as a heavy product a slurry oil and at least a portion of said slurry oil is recycled to said desuperheating zone as quench liquid.

5. The process of claim 1 wherein heavy cycle oil boiling range hydrocarbons are recycled from said fractionation zone to said desuperheating zone as quench liquid.

6. The process of claim 1 wherein said heavy liquid product recovered beneath the heat exchange section of said desuperheating zone is stripped of strippable hydrocarbons in a stripping section comprising:

a stripping vapor liquid contact means operating at stripping conditions sufficient to remove strippable hydrocarbons boiling below the heavy cycle oil boiling range from said heavy liquid stream from said heat exchange section;

a heavy liquid inlet, within an upper portion of the stripping section, connective with the heavy liquid product outlet from said desuperheating zone;

a stripping vapor inlet, within a lower portion of the stripping section;

at least one stripper vapor outlet at an upper portion of said stripping section for removal of a stripped hydrocarbon vapor stream;

at least one stripper liquid outlet at a lower portion of said stripping section for removal of a stripped hydrocarbon liquid stream comprising hydrocarbons boiling above the light cycle oil boiling range.

7. The process of claim 6 wherein said stripping section strips light and heavy cycle oil from said heavy liquid product from said desuperheating zone.

8. An apparatus for fractionating a superheated vapor stream comprising a plurality of liquid products comprising a vertical distillation apparatus having a height of at least 20 meters, and comprising an upper desuperheating means and a lower fractionation means;

said desuperheating means comprising:

a vapor inlet having an elevation of at least 10 meters for superheated vapor;

a liquid inlet at an upper portion of said desuperheating means for addition of a recycled liquid hydrocarbon stream having a boiling point from the lower fractionation means;

a vapor liquid contact means for direct contact heat exchange of superheated vapor with the vaporizable liquid to produce a vaporized product fraction and a condensed heavy liquid product;

at least one vapor outlet at an upper portion of said desuperheating means connective with said lower fractionation means for removal of vapor from the desuperheating means;

at least one heavy liquid product outlet at a lower portion of said desuperheating means for removal of a hydrocarbon liquid stream comprising hydrocarbons having a boiling point above the boiling point of the recycled liquid hydrocarbon stream; and said fractionation means having at least a lower portion and an upper portion and comprising:

a fractionation section having vapor liquid contact means for fractionation of vapor from said desuperheating section into product fractions, said fractionation section having a plurality of outlet means for removal of normally liquid products streams selected from the group of naphtha boiling range hydrocarbons, light cycle oil boiling range hydrocarbons, heavy cycle oil boiling range hydrocarbons and mixtures thereof; and;

a fractionator vapor inlet in said lower portion of the fractionation means, said fractionator vapor inlet operatively connected with said vapor outlet of said desuperheating means;

a recycle liquid line in said lower portion off said fractionation means connective with said desuperheating means for recycle of a normally liquid product stream from said fractionation means up to said desuperheating means.

9. The apparatus of claim 8 wherein said vapor inlet to said desuperheating means is at an elevation above 30 meters.

10. The apparatus of claim 8 wherein the desuperheating means is in vertical alignment with and above said fractionation means.

11. The apparatus of claim 8 wherein the fractionation means produces a bottom liquid product and the bottom liquid product from the fractionation means is charged to the upper portion of the desuperheating means.

12. An apparatus for fractionating a hydrocarbon vapor stream, said hydrocarbon vapor comprising normally gaseous hydrocarbons, naphtha boiling range hydrocarbons, and light and heavy cycle oil boiling range hydrocarbons; said apparatus comprising a vertical distillation column having a height of at least 20 meters, said apparatus comprising:

a) a direct contact heat exchange means, within an upper 40% of the elevation of the vertical column, comprising:

a vapor liquid contact means, a vapor inlet at a lower portion for said vapor stream, a liquid inlet at an upper portion for admission of a liquid hydrocarbon stream, at least one vapor outlet above said vapor liquid contact means for removal of a hydrocarbon vapor stream comprising naphtha boiling range hydrocarbons;

at least one liquid outlet below said vapor liquid contact means for removal of a hydrocarbon liquid stream comprising hydrocarbons boiling above the light cycle oil boiling range; and b) a fractionation means, under said direct contact heat exchange means, said fractionation means comprising:

a vapor liquid contact fractionation means adapted to fractionate hydrocarbons into liquid product fractions;

a vapor inlet, within a lower 25% of the elevation of said distillation column, said vapor inlet operatively connected with the vapor outlet from the heat exchange means;

at least one vapor outlet in an upper portion of said fractionation means for removal of normally gaseous hydrocarbons;

at least one heavy liquid outlet in a lower portion of said fractionation means for removal of a hydrocarbon liquid stream comprising hydrocarbons boiling above the light cycle oil boiling range.

13. The apparatus of claim 12 further comprising means to recycle at least a portion of the heavy liquid product boiling above the light cycle oil boiling range from said fractionation means to said direct contact heat exchange means.

* * * * *